US009288587B2

(12) United States Patent
Ma

(10) Patent No.: US 9,288,587 B2
(45) Date of Patent: Mar. 15, 2016

(54) WIRELESS BINAURAL COMPRESSOR

(75) Inventor: Guilin Ma, Lyngby (DK)

(73) Assignee: GN RESOUND A/S, Ballerup (DK)

( * ) Notice: Subject to any disclaimer, the term of this patent is extended or adjusted under 35 U.S.C. 154(b) by 845 days.

(21) Appl. No.: 13/181,397

(22) Filed: Jul. 12, 2011

(65) Prior Publication Data

US 2013/0010973 A1 Jan. 10, 2013

(30) Foreign Application Priority Data

Jul. 4, 2011 (EP) ..... 11172536

(51) Int. Cl.
*H04R 25/00* (2006.01)
*H04R 5/00* (2006.01)

(52) U.S. Cl.
CPC ..... *H04R 25/552* (2013.01); *H04R 25/356* (2013.01); *H04R 25/407* (2013.01)

(58) Field of Classification Search
CPC ..... H04R 2225/55; H04R 2225/51; H04R 2225/43; H04R 25/552; H04R 25/554; H04B 5/0006; H04B 5/02; H04W 56/00; H04W 72/00
USPC ..... 381/23.1, 94.8, 104, 106–107, 381/312–331; 455/101, 41.2–41.3, 416, 455/347, 566, 425
See application file for complete search history.

(56) References Cited

U.S. PATENT DOCUMENTS 5,479,522 A 12/1995 Lindemann et al.
5,850,610 A * 12/1998 Testani et al. ..... 455/512
6,549,633 B1 4/2003 Westermann
7,305,100 B2 12/2007 Pedersen
7,630,507 B2 12/2009 Kates
7,773,763 B2 * 8/2010 Pedersen ..... 381/321
8,054,879 B2 * 11/2011 Fallon et al. ..... 375/240
8,526,624 B2 9/2013 Bramslow et al.
2002/0131613 A1 * 9/2002 Jakob ..... 381/312

(Continued)

FOREIGN PATENT DOCUMENTS

CN 1640190 7/2005
CN 101287306 10/2008

(Continued)

OTHER PUBLICATIONS

Japanese Office Action dated Aug. 6, 2013, for corresponding JP Patent Application No. 2012-148786.

(Continued)

*Primary Examiner* — Davetta W Goins
*Assistant Examiner* — Kuassi Ganmavo
(74) *Attorney, Agent, or Firm* — Vista IP Law Group, LLP

(57) ABSTRACT

A binaural hearing aid system includes a first hearing aid and a second hearing aid, each of which comprising a processor that is configured to process the digital input signal in accordance with a signal processing algorithm into a processed digital output signal, the processor including a compressor for compensation of dynamic range hearing loss based on the signal level, wherein wireless data communication of signal parameter from one of the first and the second hearing aids is performed at a data transmission rate with a time period between consecutive transmissions of the signal parameter from the one of the first and second hearing aids that is longer than an attack and release time of at least one of the compressors.

31 Claims, 5 Drawing Sheets

(56) References Cited

U.S. PATENT DOCUMENTS

Figure 1:
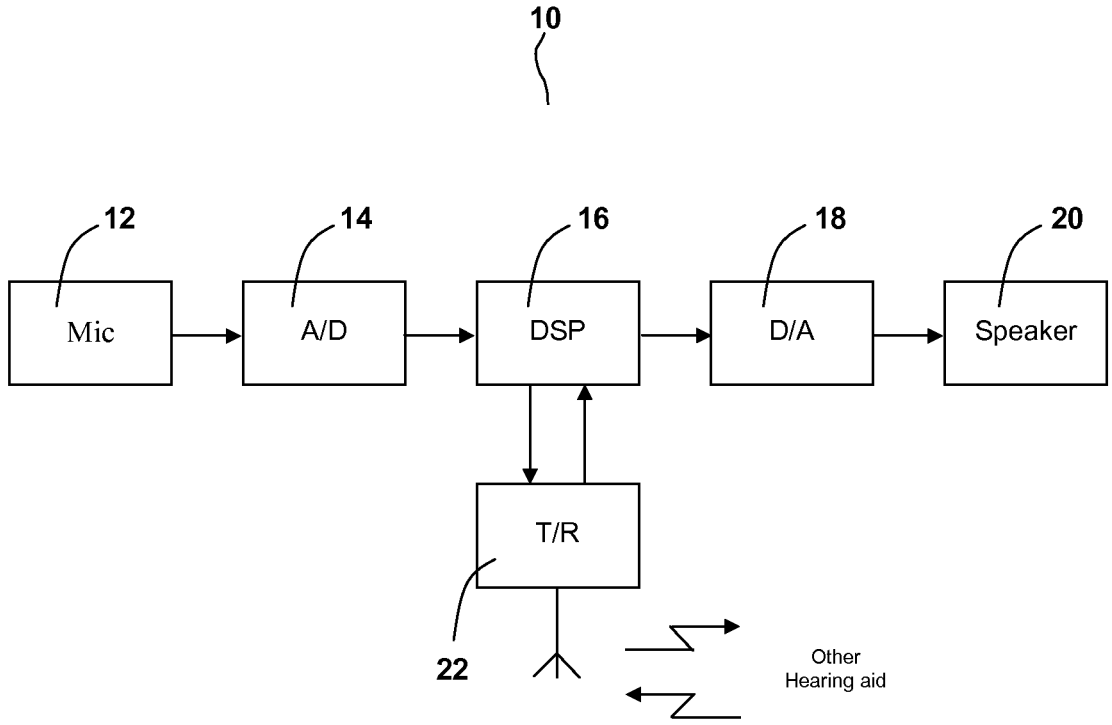

| | | | | |
|---|---|---|---|---|
| 2004/0057591 | A1* | 3/2004 | Beck et al. | 381/315 |
| 2004/0190734 | A1 | 9/2004 | Kates | |
| 2006/0067550 | A1* | 3/2006 | Puder | H04R 25/554 381/315 |
| 2008/0212810 | A1 | 9/2008 | Pedersen | |
| 2009/0052703 | A1* | 2/2009 | Hammershoi | 381/310 |
| 2010/0002886 | A1* | 1/2010 | Doclo | H04R 25/552 381/23.1 |
| 2010/0020995 | A1 | 1/2010 | Elmedyb | |
| 2010/0128906 | A1* | 5/2010 | Haenggi | H04R 25/558 381/315 |
| 2010/0183158 | A1 | 7/2010 | Haykin | |
| 2011/0249823 | A1* | 10/2011 | Thomsen et al. | 381/23.1 |

FOREIGN PATENT DOCUMENTS

| | | | |
|---|---|---|---|
| EP | 1 802 168 | A1 | 6/2007 |
| EP | 1 981 309 | A1 | 10/2008 |
| WO | WO 88/09105 | | 11/1988 |
| WO | 99/43185 | A1 | 8/1999 |
| WO | 03/015468 | A1 | 2/2003 |
| WO | 2010 028683 | | 3/2010 |

OTHER PUBLICATIONS

Extended European Search Report dated Dec. 14, 2011, for EP Patent Application No. 11172549.5.

Extended European Search Report for EP Application No. 11172536.2, Dated Dec. 1, 2011.

Non-final Office Action dated Feb. 13, 2014 for U.S. Appl. No. 13/180,950.

First Office Action dated Aug. 26, 2014 for related Chinese Patent Application No. 201210231010.7, 13 pages.

Final Office Action dated Sep. 3, 2014 for U.S. Appl. No. 13/180,950.

Notice of Reasons for Rejection dated Jul. 1, 2014 for related JP Patent Application No. 2012-148786, 6 pages.

Chinese Office Action dated Jun. 5, 2014 for related Chinese Patent Application No. 201210230422.9.

Notice of Allowance and Fees Due dated Dec. 10, 2014 for U.S. Appl. No. 13/180,950.

Notice of Allowance and Fees Due dated Aug. 28, 2015 for related U.S. Appl. No. 13/180,950.

* cited by examiner

WIRELESS BINAURAL COMPRESSOR

RELATED APPLICATION DATA

This application claims priority to and the benefit of European patent application No. EP11172536.2, filed on Jul. 4, 2011, pending, the entire disclosure of which is expressly incorporated by reference herein.

FIELD

The field of the subject application relates to hearing aid.

BACKGROUND

A hearing impaired person typically suffers from a loss of hearing sensitivity that is frequency dependent and dependent upon the sound level. Thus, a hearing impaired person may be able to hear certain frequencies (e.g., low frequencies) as well as a person with normal hearing, but unable to hear sounds with the same sensitivity as the person with normal hearing at other frequencies (e.g. high frequencies). At frequencies with reduced sensitivity, the hearing impaired person may be able to hear loud sounds as well as the person with normal hearing, but unable to hear soft sounds with the same sensitivity as the person with normal hearing. Thus, the hearing impaired person suffers from a loss of dynamic range.

Typically, a compressor in a hearing aid is used to compress the dynamic range of sound arriving at the hearing aid user in order to compensate the dynamic range loss of the user by matching the dynamic range of sound output by the hearing aid to the dynamic range of the hearing of that user. The slope of the input-output compressor transfer function ($\Delta I/\Delta O$) is referred to as the compression ratio. Generally the compression ratio required by a user is not constant over the entire input power range, i.e. typically the compressor characteristic has one or more knee-points.

Typically, the degree of dynamic hearing loss of a hearing impaired user is different in different frequency channels. Thus, compressors may be provided to perform differently in different frequency channels, thereby accounting for the frequency dependence of the hearing loss of the intended user. Such a multi-channel or multi-band compressor divides an input signal into two or more frequency channels or frequency bands and then compresses each channel or band separately. The parameters of the compressor, such as compression ratio, positions of knee-points, attack time constant, release time constant, etc. may be different for each frequency channel.

Efficient hearing of a person with normal hearing is binaural in nature and thus, utilizes two input signals, i.e. the binaural input signal, namely the sound pressure levels as detected at the eardrums in the right and left ear, respectively.

For example, human beings detect and localize sound sources in three-dimensional space by means of the binaural input signal. It is not fully known how the hearing extracts information about distance and direction to a sound source, but it is known that the hearing uses a number of cues for the determination. Among the cues are coloration, interaural time difference, interaural phase difference and interaural level difference.

A user listening to a sound source positioned at an angle to the right of the forward looking direction of the user will receive sound with a sound pressure level at the right ear that is higher than the sound pressure level received at the left ear. The sound will also arrive at the right ear prior to arrival at the left ear. Interaural level difference and interaural time difference are considered to be the most important directional cues used by the binaural hearing to determine the direction to the sound source.

Another aspect of binaural hearing is explained in U.S. Pat. No. 7,630,507 disclosing that loud sounds received at one ear of a person with normal hearing has a masking effect to sounds received at the other ear of the human, i.e. the sensitivity to sounds is reduced at the other ear. Binaural compression algorithms are disclosed in U.S. Pat. No. 7,630,507 for use in a binaural hearing aid system for restoring the binaural masking of normal hearing.

In U.S. Pat. No. 7,630,507, sound pressure levels; or signals derived from sound pressure levels, such as peak detector output signals, of both hearing aids are continuously available in both hearing aids for binaural compression.

However, continuous wireless transmission of sound pressure levels or peak detector outputs from one hearing aid to the other of the binaural hearing aid system leads to excessive power consumption by the hearing aids due to the high power consumption of wireless transceivers during wireless transmission and reception.

Typically, in a hearing aid only a limited amount of power is available from the power supply. For example, in a hearing aid, power is typically supplied from a conventional $ZnO_2$ battery with limited energy storage capacity, and frequent exchange of the battery is a serious concern for users of hearing aids, and not acceptable.

SUMMARY

New binaural hearing aid systems and methods are disclosed herein in which binaural processing of input sound is performed based on wireless transmission of data between the hearing aids of the system with a low data rate and therefore with low power consumption.

In some embodiments, a binaural hearing aid system is disclosed with wireless data transmission between the two hearing aids, and wherein compression for compensation of dynamic range hearing loss in one hearing aid is performed in dependence of a signal parameter received from the other hearing aid in order to provide co-ordinated binaural compression in the two hearing aids whereby binaural hearing is improved even though data transmission between the hearing aids of the binaural hearing aid system is performed at a data transmission rate with a time period between consecutive transmissions of the signal parameter that is longer than the attack and release times of the compressors.

In accordance with some embodiments, a binaural hearing aid system includes a first hearing aid and a second hearing aid, each of which comprising a microphone and an A/D converter for provision of a digital input signal in response to sound signals received at the microphone, a signal level detector for determining and outputting a signal level that is a first function of the digital input signal, a signal parameter detector for determining and outputting a signal parameter that is a second function of a signal in the hearing aid, a transceiver for wireless data communication of the signal parameter with the other hearing aid, a processor that is configured to process the digital input signal in accordance with a signal processing algorithm into a processed digital output signal, the processor including a compressor for compensation of dynamic range hearing loss based on the signal level, and a D/A converter and an output transducer for conversion of the processed digital output signal to an acoustic output signal, wherein, in at least one frequency channel of at least one of the compressors, a gain of the at least one of the compressors is controlled by a compressor control signal that is a third function of the signal level and the signal parameter of the respective hearing aid, and the signal parameter received from the other hearing aid, and wherein the wireless data communication of the signal parameter from one of the first and the second hearing aids is performed at a data transmission rate with a time period between consecutive transmissions of the signal parameter from the one of the first and second hearing aids that is longer than an attack and release time of at least one of the compressors.

In accordance with other embodiments, a hearing aid system includes a first hearing aid configured to communicate with a second hearing aid, the first hearing aid comprising a microphone and an A/D converter for provision of a digital input signal in response to sound signals received at the microphone, a signal level detector for determining and outputting a signal level that is a first function of the digital input signal, a signal parameter detector for determining and outputting a signal parameter that is a second function of a signal in the first hearing aid, a transceiver for wireless data communication of the signal parameter with the second hearing aid, a processor that is configured to process the digital input signal in accordance with a signal processing algorithm into a processed digital output signal, the processor including a compressor for compensation of dynamic range hearing loss based on the signal level, and a D/A converter and an output transducer for conversion of the processed digital output signal to an acoustic output signal, wherein, in the first hearing aid, a gain of the compressor is controlled by a compressor control signal that is a third function of the signal level and the signal parameter of the first hearing aid, and an additional signal parameter received from the second hearing aid, and wherein the transceiver of the first hearing aid is configured to communicate the signal parameter with the second hearing aid at a data transmission rate with a time period between consecutive transmissions of the signal parameter from the first hearing aid that is longer than an attack and release time of the compressor.

In accordance with other embodiments, a method in a hearing aid system with a first hearing aid and a second hearing aid is provided. The method includes, in the first hearing aid, converting received sound into an input signal, determining a signal level that is a first function of the input signal, determining a signal parameter that is a second function of a signal in the first hearing aid, performing wireless communication of the signal parameter with the second hearing aid, processing the input signal in accordance with a signal processing algorithm into a processed digital output signal, wherein the act of processing includes compression for compensation of dynamic range hearing loss based on the signal level, and converting the processed digital output signal to an acoustic output signal, wherein, in the first hearing aid, controlling compression gain as a function of the signal level and signal parameter of the first hearing aid, and an additional signal parameter received from the second hearing aid, and wherein the act of performing wireless communication comprises transmitting the signal parameter from the first hearing aid at a data transmission rate with a time period between consecutive transmissions of the signal parameter that is longer than an attack and release time of the compressor in the first hearing aid.

The compressor may be a single-channel compressor, but preferably the compressor is a multi-channel compressor.

The input to the signal level detector is preferably the digital input signal. The digital input signal may originate from a single microphone or from a combination of output signals of a plurality of microphones. For example, the digital input signal may be a directional microphone signal output from a beam-forming algorithm operating on two inputs from two omni-directional microphones.

The signal level detector preferably calculates an average value of the digital input signal, such as an rms-value, a mean amplitude value, a peak value, an envelope value, e.g. as determined by a peak detector. etc. In the event that the output of the signal level detector is used directly as the compressor control signal, the time constants of the output of the signal level detector define the attack and release times of the compressor.

The signal level detector may calculate running average values of the digital input signal; or operate on block of samples. Preferably, the signal level detector operates on block of samples whereby required processor power is lowered.

The input to the signal parameter detector may also be the digital input signal, and the signal parameter detector may calculate the same type of parameters as the signal level detector; with the same or with different time constants.

In some binaural compressors, the signal level detector and the signal parameter detector are identical and form a single signal processing unit preferably with the digital input signal as the input and an output signal that is used as both the signal level and the signal parameter.

However, the input to the signal parameter detector may be another signal different from the digital input signal, for example the output signal from the compressor, and the signal parameter detector may calculate other types of parameters than the types of parameters calculated by the signal level detector, for example spectral parameters, such as long-term average spectral parameters, peak spectral parameters, minimum spectral parameters, cepstral parameters, etc., or other temporal parameters, such as Linear Predictive Coding parameters, statistical parameters, such as amplitude distributions statistics etc., of the input signal to the signal parameter detector.

The signal parameter detector may calculate running average values of the digital input signal; or operate on block of samples. Preferably, the signal parameter detector operates on block of samples whereby required processor power is lowered.

The new binaural hearing aid system performs binaural signal processing due to the fact that in at least one frequency channel of at least one of the compressors, the gain of the compressor is controlled by a compressor control signal that is a function of the signal level and signal parameter of the respective hearing aid accommodating the compressor, and the signal parameter received from the other hearing aid. In this way, improved binaural hearing impairment compensation is facilitated.

In order to keep power consumption at a low level, wireless data communication of the signal parameter is performed at a data rate that is slower than the attack and release times of the compressor, i.e. the time between consecutive transmissions of the signal parameter is longer than the attack and release times of the compressor. Therefore, functions of signal parameters are identified for use in the binaural compression that vary at a rate that makes them suitable for use in connection with low data rate wireless transmission.

The data rate may be lower than 100 Hz, such as lower than 90 Hz, such as lower than 80 Hz, such as lower than 70 Hz, such as lower than 60 Hz, such as lower than 50 Hz, etc.

For example, the new binaural hearing aid system may be configured to perform binaural compression of the incoming binaural sound signal in such a way that the user maintains a sense of direction to sound sources.

When the user wears a conventional binaural hearing aid system, the compressors of the hearing aids typically do not change, or substantially do not change, the interaural time difference. As used in this specification, a value is considered "substantially unchanged" or "do not change" if it does not vary by more than 20% or less, and more preferably, if it does not vary by more than 10% or less. However, since the sound pressure levels received at the two ears are different for most directions of sound sources, the received sounds at the left and right ear, respectively, may be subjected to different gains leading to a change in interaural level difference which in turn leads to loss of sense of direction for the user.

In order to avoid loss of sense of direction, the new binaural hearing aid system performs compression at the two ears of the user in a co-ordinated way such that interaural level differences remain unchanged, or substantially unchanged, after compression.

Thus, at least one of the hearing aids of the binaural hearing aid system is configured to acquire a signal containing information on the sound pressure level of sound received by the other hearing aid of the binaural hearing aid system and use the information to modify the resulting compression of the digital input signal of the hearing aid in question in correspondence with compression performed in the other hearing aid, for example in such a way that interaural level differences remain unchanged after the binaural compression.

In the event that a hearing impaired person has a symmetric hearing loss, i.e. the hearing impaired person has the same hearing loss in both ears, the compressors in hearing aids will have identical characteristics; and therefore, if the compressor control signals have identical values, or substantially identical values, the compressor gains will also be identical, or substantially identical, and the interaural level difference before and after compression will remain unchanged, or substantially unchanged.

In the event that a hearing impaired person has an asymmetric hearing loss, i.e. the hearing impaired person has a different hearing loss in the left and right ear; surprisingly, sense of direction is nevertheless maintained after compression by adjusting the compressor control signals to have identical, or substantially identical, values as explained above for a hearing aid person with symmetric hearing loss. Sense of direction is maintained even though, in this case, the interaural level difference is not maintained at the output of the hearing aids, since the hearing aids perform different hearing loss compensation in the left and right ear. However, typically, the hearing impaired person has not lost sense of direction without hearing aids, so the brain seems to be able to adjust determination of direction to the changed interaural level difference provided by the hearing impaired ears. Adjustment of the compressor control signals to have identical, or substantially identical, values, as explained above for a hearing aid person with symmetric hearing loss, seems to maintain the changed interaural level difference provided by the hearing impaired ears so that sense of direction is also maintained in this way for hearing impaired persons with asymmetric hearing loss.

Thus, the new binaural hearing aid system may be configured to adjust the compressor control signals to be of the same value, or substantially the same value, in order to maintain sense of direction of the hearing impaired person.

The interaural level difference may for example be determined based on the signal parameter that in this case is a function of the sound pressure level of sound received by the microphone, such as an rms-value, a mean amplitude value, a peak value, an envelope value, e.g. as determined by a peak detector, etc. The interaural level difference may for example be determined every time the signal parameter value is transmitted to the other hearing aid. Simultaneous, or substantially simultaneous, with the determination of the signal parameter value in the transmitting hearing aid, the signal parameter value of the other hearing aid is stored in the other hearing aid. When the corresponding signal parameter value is received from the other hearing aid, the two simultaneously determined signal parameter values are subtracted to determine the interaural level difference. In the event that the interaural level difference is positive, i.e. the signal parameter value corresponding to the sound pressure level of the hearing aid that received the signal parameter value from the other hearing aid is largest, the signal level is used as the compressor control signal. In the event that the interaural level difference is negative, i.e. the signal parameter value corresponding to the sound pressure level of the hearing aid that received the signal parameter value from the other hearing aid is smallest, the interaural level difference is added to the signal level, and the sum is used as the compressor control signal, whereby the compressor control signals of the two hearing aids are adjusted in correspondence to be of the same, or substantially the same, value, whereby sense of direction is maintained.

Thus, the compressor control signal of each of the first and second hearing aids is a function of a successfully transmitted signal parameter from the other hearing aid, and a concurrent signal parameter of the hearing aid in question, and the signal level of the hearing aid in question.

In a single-channel compressor, the compressor control signal is simply adjusted as disclosed above. In a multi-channel compressor, the compressor has individual compressor control signals in each of the frequency channels of the compressor, and each of the individual compressor control signal may be adjusted as disclosed above; or, alternatively, only some of the individual compressor control signals, such as compressor control signals in high frequency channels, are adjusted as disclosed above, while other compressor control signals, such as compressor control signals in low frequency channels, remain monaural, i.e. the compressor control signal is a function only of the sound pressure level of the input signal of the hearing aid accommodating the compressor as in a conventional monaural compressor. For example, in one binaural hearing aid system, only one of the individual compressor control signals, such as a compressor control signal in a high frequency channel, is adjusted as disclosed above, while the remaining compressor control signals, such as compressor control signals in low frequency channels, remain monaural.

The new binaural hearing aid system may be configured to perform modelling of healthy COCB effects for the hearing impaired as disclosed in U.S. Pat. No. 7,630,507; however modified as disclosed above in that wireless data transmission of the signal parameter between the hearing aids of the binaural hearing aid system is performed at a data transmission rate with a time period between consecutive transmissions of the signal parameter that is longer than the attack and release times of the compressors.

The new binaural hearing aid system may be configured to perform the modelling of the healthy COCB effects in combination with maintaining sense of direction as disclosed above. In general, binaural compression gain $G_R$, $G_L$ at time t in each hearing aid of the binaural hearing aid system is a function of sound pressure levels at the right ear and the left ear:

$$G_{R,t}=f(x_{R,t},x_{L,t}),$$

Wherein $x_{R,t}$ is the sound pressure level received at the hearing aid at the right ear at time t, and $x_{L,t}$ is the sound pressure level received at the hearing aid at the left ear at time t.

Since the signal parameter that is transmitted from one of the hearing aids to the other is transmitted at a low data rate, a function of the signal parameters of the hearing aids is identified for use in the binaural compression that varies slowly and therefore can be calculated with sufficient accuracy based on the signal parameters transmitted at the low data rate.

For example, location of sound sources depends on the interaural level difference ILD as a function of time t:

$$\mathrm{ILD}_t = X_{R,t} - X_{L,t}$$

Wherein $X_{R,t}$ is a function of the sound pressure level $x_{R,t}$, for example representing an rms-value, a mean amplitude value, a peak value, an envelope value, e.g. as determined by a peak detector, etc., and $X_{I,t}$ is a function of the sound pressure level $x_{I,t}$, for example representing an rms-value, a mean amplitude value, a peak value, an envelope value, e.g. as determined by a peak detector, etc.

Since the interaural level difference is a slow varying function of time, the following approximation is made:

$$\frac{d\,ILD}{dt} \approx 0 \Rightarrow ILD_t \approx ILD_{t_0}$$

wherein $t_0$ is the time of determining the signal parameter X in both hearing aids; and further:

$$X_{L,t} \approx X_{R,t} - \mathrm{ILD}_{t_o}$$

$$X_{R,t} \approx X_{L,t} + \mathrm{ILD}_{t_o}$$

The signal levels $X'_{R,t}$ and $X'_{I,t}$; determined in the hearing aids at the left and right ears, respectively, are also functions of the respective sound pressure levels at the right and left hearing aids, for example representing rms-values, mean amplitude values, peak values, envelope values, e.g. as determined by peak detectors, etc., of the respective sound pressure level. In many cases, the signal levels $X'_{R,t}$ and $X'_{I,t}$; respectively, have the attack and release time constants of the respective compressors. The above approximation is also valid for the signal levels:

$$X'_{L,t} \approx X'_{R,t} - \mathrm{ILD}_{t_o}$$

$$X'_{R,t} \approx X'_{L,t} + \mathrm{ILD}_{t_o}$$

Binaural compression may be performed in such a way that if the interaural level difference is positive, i.e. the sound pressure level is largest at the right ear, the compressor control signal in the hearing aid at the right ear is set to be equal to signal level $X'_{R,t}$, while the compressor control signal in the hearing aid at the left ear is set to the sum of the signal level $X'_{L,t}$ and $\mathrm{ILD}_{t0}$, i.e. the compressor control signal is shifted to:

$$\hat{X}_{L,t} = X'_{L,t} + \mathrm{ILD}_{t_o}$$

so that $$\hat{X}_{L,t} \approx X'_{R,t}$$

and vice versa if the interaural level difference is negative.

As a result, the gain of the compressor of each of the hearing aids of the binaural hearing aid system is a function of three signals as shown below for the hearing aid at the right ear:

$$G_{R,t} = f(X'_{R,t}, \mathrm{ILD}_{t_o}) = f(X'_{R,t}, X_{R,t_o}, X_{L,t_o})$$

In this way, the compressor control signal of one hearing aid will always have the same value, or substantially the same value, as the compressor control signal of the other hearing aid, whereby sense of direction is maintained irrespective of the type of hearing loss, i.e. symmetric or asymmetric hearing loss, of the user. It is noted that the values of the signal parameter X at time $t_0$ are old as compared to the current value at time t of the signal level X' input to the second binaural unit. However, since the signal parameters are used to form a slowly varying parameter, such as the interaural level difference, the difference in time of determination of the signal level X' and the respective signal parameters X does not affect the performance of the new binaural hearing aid system.

Other forms of binaural compression may be performed in which, the interaural level difference above is substituted with another slowly varying function:

$$h(X_{L,t}, X_{R,t})$$

where $$\frac{dh}{dt} \approx 0 \Rightarrow h_t \approx h_{t_0}$$

And therefore $$h(X_{L,t}, X_{R,t}) \approx h(X_{L,t_o}, X_{R,t_o})$$

and current values of the binaural compressor gain may for example be formed according to the following equations:

$$G_{R,t} = f(X'_{R,t}, h(X_{L,t}, X_{R,t}))$$

$$G_{L,t} = f(X'_{L,t}, h(X_{L,t}, X_{R,t}))$$

For example, sense of direction may be maintained with compressor control signals different from the control signals explained above; however still of substantially identical values. In the example given above, the hearing aid receiving sound with the largest sound pressure level is controlled monaurally so that optimum hearing loss compensation is also performed by the hearing aid in question. In the other hearing aid, the compressor control signal is larger than when controlled monaurally whereby hearing loss compensation for the respective ear may not be optimal, and thus another compressor control scheme may be selected that offers a better compromise between maintaining sense of direction and performing individual hearing loss compensation in both ears.

When the same gain is applied in both hearing aids there is a deviation between the applied gain G and the gain $L_L$, $L_R$ that would have been applied monaurally:

$$\Delta_L - G - L_L$$

$$\Delta_R = G - L_R$$

Thus, the gain G may be selected in the range between $L_L$ and $L_R$ in order to provide a more desirable compromise of hearing loss compensation in the two ears while still maintaining sense of direction.

Further, slight changes of the interaural level differences may tolerated by some users in order to obtain a better simultaneous individual hearing loss compensation in both ears.

In this case, the function h is equal to the ILD plus the tolerable change of ILD.

Instead of transmitting the signal parameter from both hearing aids, the signal parameter may be transmitted by one of the hearing aids, and a corresponding value of the function h, e.g. the ILD, may be determined in the other hearing aid and the determined value of h may be transmitted to the hearing aid transmitting the signal parameter so the determined value of h can be used in the binaural compression of both hearing aids.

The new binaural hearing aid system may be configured so that each of the compressors operates on the sound signal before hearing loss compensation. Compression gain relates to input sound level. It is therefore important to determine the input level accurately in every compressor frequency channel. If hearing loss is compensated before compression then the determined input levels will be contaminated with the gain applied to compensate hearing impairment, and since the gain typically varies with frequency within a specific compressor channel, this typically leads to frequency dependent knee-points within the channels. This effect is avoided when the compressors operate on the sound signal before hearing loss compensation.

Further, the separation of frequency dependent hearing loss compensation (static gain) from compression leads to easily manageable simultaneous compensation of frequency dependent hearing loss and loss of dynamic range.

The multi-channel compressor may comprise a filter bank with linear phase filters. Linear phase filters provide a constant group delay leading to low distortion.

Alternatively, the filter bank may comprise warped filters leading to a low delay, i.e. the least possible delay for the obtained frequency resolution, and adjustable crossover frequencies of the filter bank.

The filter bank is preferably a cosine-modulated structure. A cosine-modulated structure is very efficiently implemented and can be designed so that summation of the channel output signals equals unity in the case that all gains are 0 dB (no inherent dips or bumps in the frequency response). For example a 3-channel cosine modulated structure retains its sum-to-one property when the number of taps does not exceed 7. Few taps are desired to minimize the delay and the computational load. A filter bank with three 5-tap filters has been found to provide the minimum number of filters and taps with good performance. The sum-to-one property is demonstrated below for a linear-phase filter bank:

Cosine modulation gives a low-pass filter of the form:

$[b_0 b_1 b_2 b_1 b_0]$ a band-pass filter of the form:

$[-2b_0 0 2b_2 0 -2b_0]$, and a high-pass filter of the form:

$[b_0 -b_1 b_2 -b_1 b_0]$

Summation of these three filters: $[004b_2 00]$, and preferably $b_2 = 1/4$.

It can also be shown that the resulting filter is symmetric (thus the group delay of the resulting filter is constant) independent of the gain factors $g_1$, $g_2$, $g_3$ of the individual filters:

$$g_1[b_0 b_1 b_2 b_1 b_0]+g_2[-2b_0 0 2b_2 0 -2b_0]+g_3[b_0 -b_1 b_2 - b_1 b_0]=[b_0(g_1-2g_2+g_3)\ b_1(g_1-g_3)\ b_2(g_1+2g_2+g_3)\ b_1(g_1-g_3)\ b_0(g_1-2g_2+g_3)]$$

This ensures that the compressor does not exhibit phase distortion that can destroy the sense of directivity for the user.

The principles of digital frequency warping are known and therefore only a brief overview follows. Frequency warping is achieved by replacing the unit delays in a digital filter with first-order all-pass filters. The all-pass filters implement a bilinear conformal mapping that changes the frequency resolution at low frequencies with a complementary change in the frequency resolution at high frequencies.

The z-transform of an all-pass filter used for frequency warping is given by:

$$A(z) = \frac{\lambda + z^{-1}}{1 + \lambda z^{-1}}$$

where $\lambda$ is the warping parameter. Increasing positive values of $\lambda$ leads to increased frequency resolution at low frequencies, and decreasing negative values of $\lambda$ leads to increased frequency resolution at high frequencies.

The warping parameter $\lambda$ controls the cross over frequencies. With only one warping parameter, there is a fixed relationship between the centre frequency of the centre (which is $\pi/2$ in the case of no warping) channel, and the crossover frequencies. The relationship is as follows, given warped frequency $\omega_d$ in radians between 0 and $\pi$ (in this example, the centre channel centre frequency which is actually the parameter that is controlled).

$\omega$ is determined by:

$$\omega = 2\pi f / F_s$$

Where f is the frequency, and $F_s$ is the sample frequency.

The warping factor $\lambda$ is given by the equation:

$$\lambda = \frac{\sin\left(\frac{\omega_d - \omega}{2}\right)}{\sin\left(\frac{\omega_d + \omega}{2}\right)}$$

The crossover frequencies in radians can then be computed by evaluating the following for $\pi/3$ and $2\pi/3$ $$\omega_d = \angle \frac{e^{j\omega} - \lambda}{1 - \lambda e^{j\omega}}.$$

Some hearing aids employ a filter bank in front of the compressor having more channels than the compressor and with different gains in different channels. Therefore, the effective knee-points of the compressor gain control circuits (of which there are fewer than channels in the filter bank) vary with frequency.

As already mentioned, in the illustrated compressor, the compressor gain control unit operates directly on the input signal so that each compressor channel knee-point does not vary with input signal frequency.

The output signals from the filter bank are multiplied with the corresponding individual gain outputs of the compressor gain control unit and the resulting signals are added together to form the compressed signal that is input to the amplifier.

Preferably, the compressor gain is calculated and applied for a block of samples whereby required processor power is lowered. When the compressor operates on a block of signal samples at the time, the compressor gain control unit operates at a lower sample frequency than other parts of the system. This means that the compressor gains only change every N'th sample where N is the number of samples in the block. This may generate artefacts in the processed sound signal, especially for fast changing gains. These artefacts may be suppressed by provision of low-pass filters at the gain outputs of the compressor gain control unit for smoothing gain changes at block boundaries.

The frequency channels of the compressor may be adjustable and may be adapted to the specific hearing loss in question. For example, frequency warping enables variable crossover frequencies in the compressor filter bank. Depending on the desired gain settings, the crossover frequencies are automatically adjusted to best approximate the response. During audiology measurements, the desired hearing aid gain is determined as a function of frequency at different sound input pressure levels whereby the desired compression ration as a function of frequency is determined. Finally, the crossover frequencies of the compressor filter bank are automatically optimised.

A warped compressor has a short delay, e.g. 3.5 ms at 1600 Hz, and the delay is constant also when the compressor changes gain. The short delay is particularly advantageous for hearing aids with open earpieces, since direct and amplified sound combine in the ear canal. The constant delay is very important for preservation of interaural cues. If the delay varies, the sense of localization will deteriorate or disappear.

Further, the hearing aid may comprise an output compressor for limitation of the output power of the hearing aid and connected to the output of the amplifier. The output compressor keeps the signal output of the hearing aid within the dynamic range of the device. Preferably, the output compressor has infinite compression ratio and an adjustable knee-point. The compressor is adjusted such that the gain at the knee-point in combination with the gain formed by the integer multiplier does not exceed 0 dB.

Preferably, the output compressor is a single-channel output compressor, however, multi-channel output compressors are foreseen. Alternatively, other output limiting may be utilized as is well known in the art.

DESCRIPTION OF THE DRAWING FIGURES

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

Figure 2:
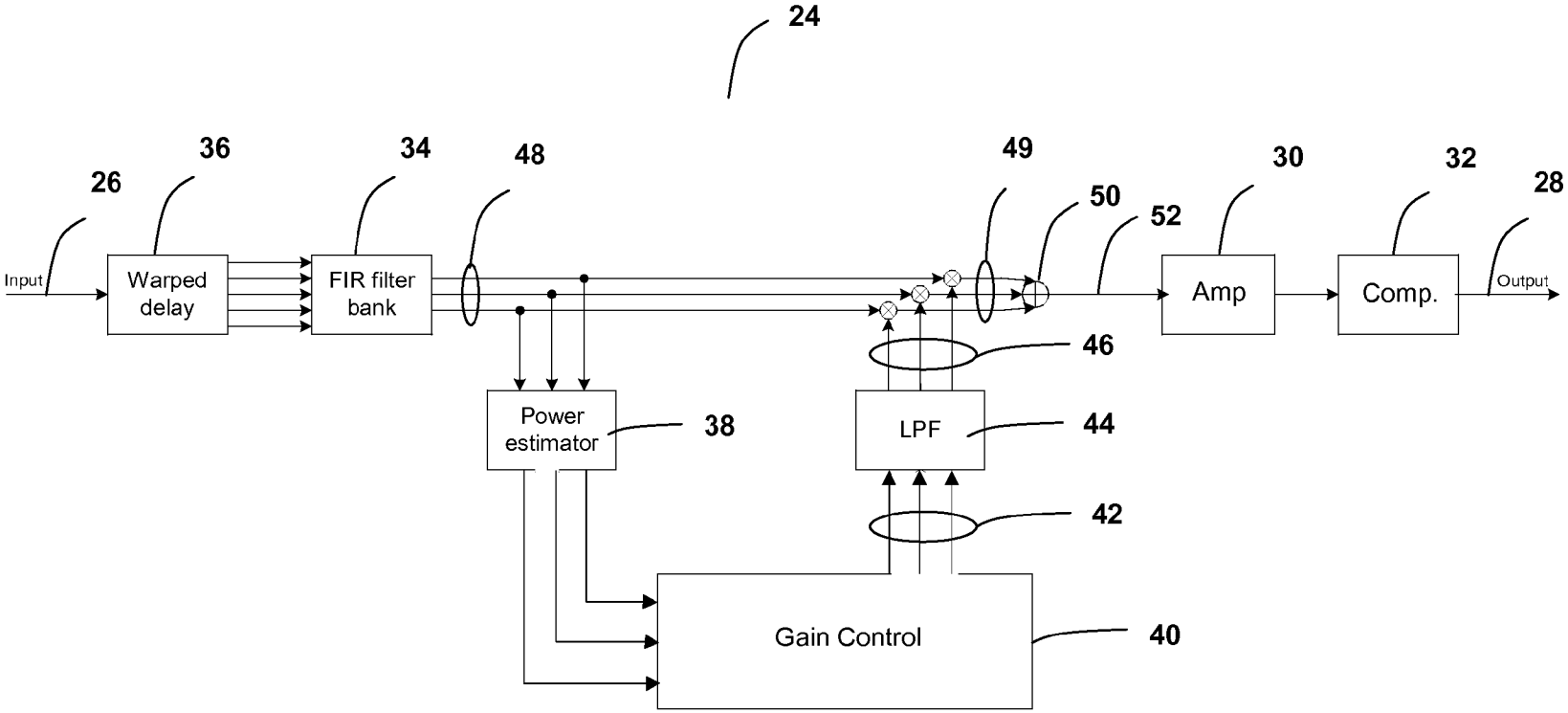
Figure 3:
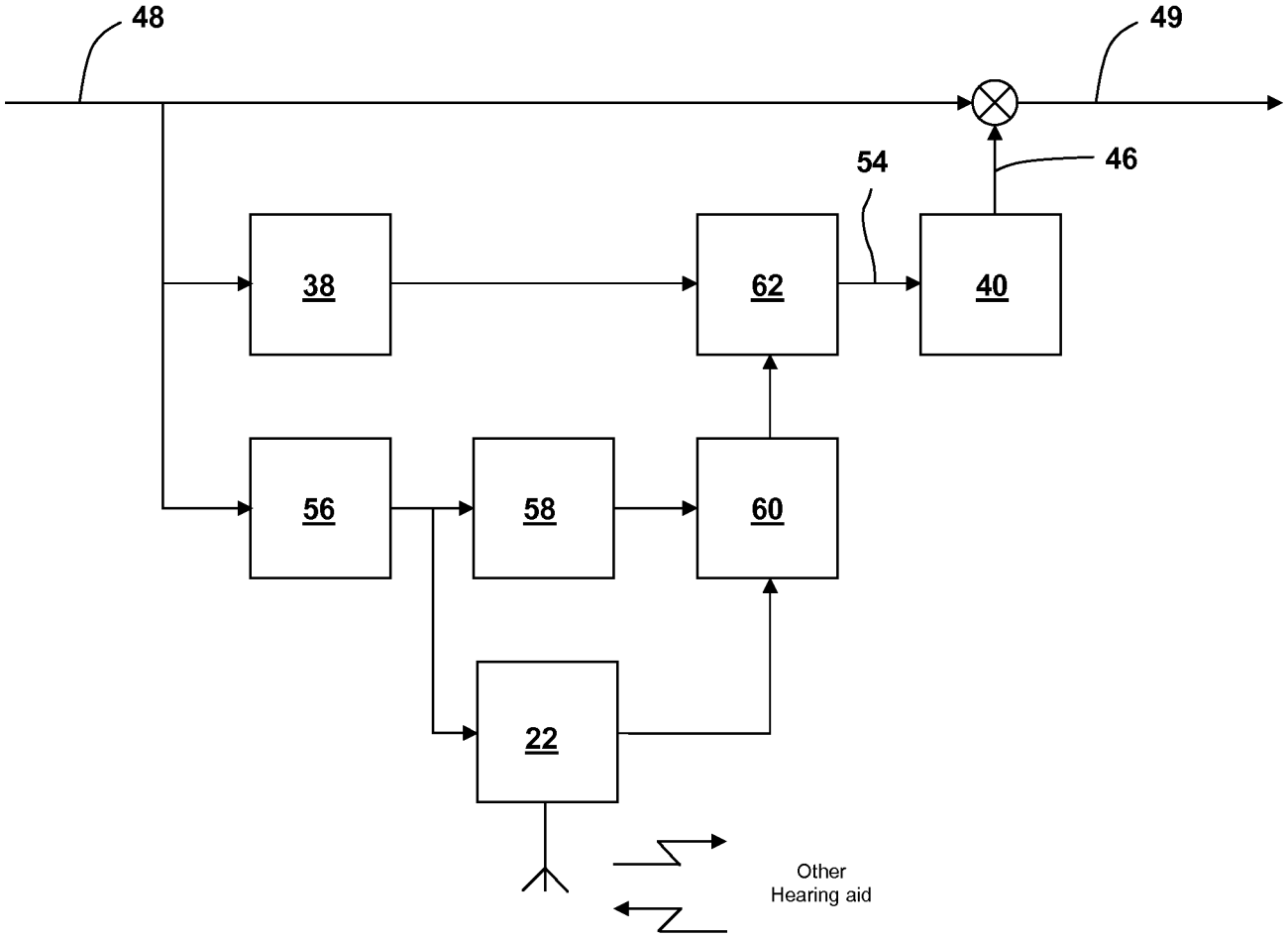
Figure 4:
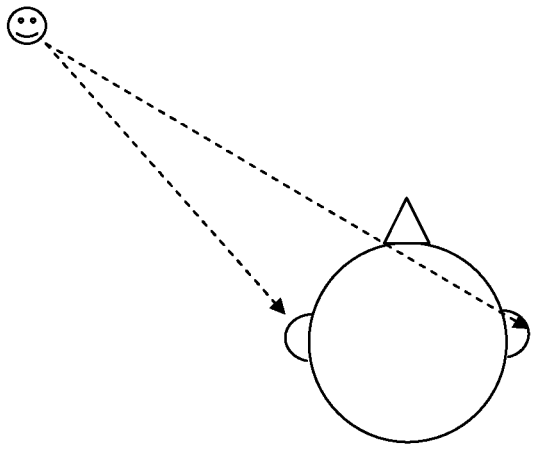
Figure 5:
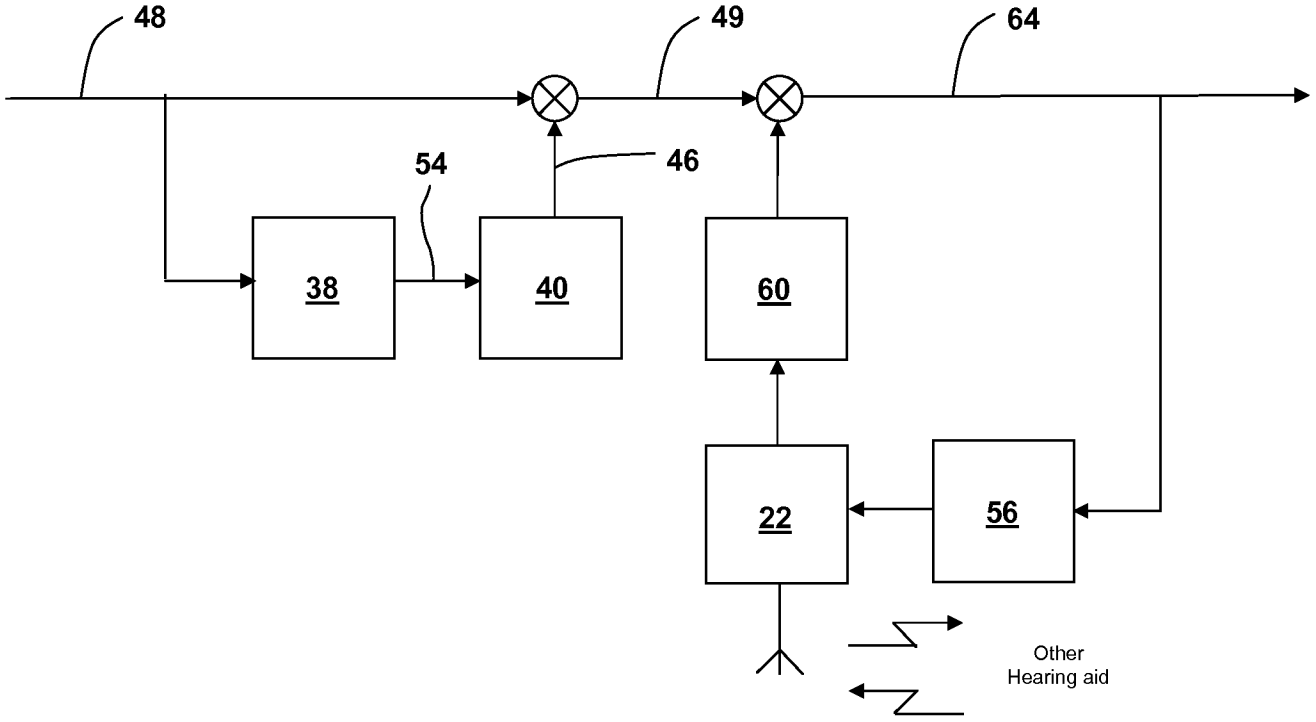

FIG. 1 is a block diagram of one of the hearing aids in the new binaural hearing aid system, FIG. 2 is a block diagram illustrating monaural control of the compressor included in the DSP of FIG. 1, FIG. 3 is a block diagram of one frequency channel in a binaural compressor preserving directional cues, FIG. 4 illustrates interaural differences, and FIG. 5 is a block diagram of one frequency channel in a binaural compressor modelling healthy COCB effects.

DETAIL DESCRIPTION OF THE EMBODIMENTS

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced and/or combined in any other embodiments even if not so illustrated or explicitly described.

The new binaural hearing aid system will now be described more fully hereinafter with reference to the accompanying drawings, in which various examples are shown. The accompanying drawings are schematic and simplified for clarity. The appended patent claims may be embodied in different forms not shown in the accompanying drawings and should not be construed as limited to the examples set forth herein. Like reference numerals refer to like elements throughout.

FIG. 1 is a simplified block diagram of one of the digital hearing aids 10 of the new binaural hearing aid system. The hearing aid 10 comprises an input transducer 12, preferably a microphone, an analogue-to-digital (A/D) converter 14 for provision of a digital input signal in response to sound signals received at the respective microphone, a signal processor 16 (e.g. a digital signal processor or DSP) that is configured to process the digital input signal in accordance with a selected signal processing algorithm into a processed output signal for compensation of hearing loss, including a compressor for compensation of dynamic range hearing loss, a digital-to-analogue (D/A) converter 18, and an output transducer 20, preferably a receiver, for conversion of the processed digital output signal to an acoustic output signal. Further, the hearing aid 10 has a transceiver 22 for wireless data communication with the other hearing aid of the binaural hearing aid system.

FIG. 2 shows parts of the compressor 24 of the signal processor 16 in more detail. In FIG. 2, only conventional parts of the compressor 24 are shown. Binaural compression will be explained in detail below with reference to FIGS. 3 and 5. FIG. 2 shows a multi-channel compressor 24. In the illustrated example, the multi-channel compressor 24 has three channels; however the compressor may be a single-channel compressor; or the compressor may have any suitable number of channels, such as 2, 3, 4, 5, 6, etc. channels. The illustrated multi-channel compressor 24 has a digital input 26 for receiving a digital input signal from the A/D converter 14, and an output 28 connected to a multi-channel amplifier 30 that performs compensation for frequency dependent hearing loss. The multi-channel amplifier 30 provides appropriate gains in each of its frequency channels for compensation of frequency dependent hearing loss. The multi-channel amplifier 30 is connected to an output compressor 32 for limitation of the output power of the hearing aid and providing the output 28.

The hearing loss compensation and the dynamic compression may take place in different frequency channels, where the term different frequency channels means different number of frequency channels and/or frequency channels with different bandwidth and/or crossover frequency.

The multi-channel compressor 24 is a warped multi-channel compressor that divides the digital input signal into the warped frequency channels with a warped filter bank comprising filter bank 34 with warped filters providing adjustable crossover frequencies, which are adjusted to provide the desired response in accordance with the users hearing impairment. The filters are 5-tap cosine-modulated filters.

Non-warped FIR filters operate on a tapped delay line with one sample delay between the taps. By replacing the delays with first order all-pass filters, frequency warping is achieved enabling adjustment of crossover frequencies. The warped delay unit 36 has five outputs. The five outputs constitutes a vector $w=[W_0\ W_1\ W_2\ W_3\ W_4]^T$ at a given point in time, which is led into the filter bank where the three channel output y, is formed. The filter bank is defined by:

$$B=\begin{bmatrix} b_0 & b_1 & b_2 & b_1 & b_0 \\ -2b_0 & 0 & 2b_2 & 0 & -2b_0 \\ b_0 & -b_1 & b_2 & -b_1 & b_0 \end{bmatrix}$$

The output of the filter bank y is:

$$y=Bw$$

The vector y contains the channel signals.

The choice of filter coefficients is a trade-off between stop-band attenuation in the low and high frequency channels, and stop-band attenuation in the middle channel. The higher attenuation in the low and high frequency channels, the lower attenuation in the middle channel.

The multi-channel compressor 24 further comprises a multi-channel signal level detector 38 for calculation of the sound pressure level or power in each of the frequency channels of the filter bank 34. The resulting signals constitute the compressor control signals and are applied to the multi-channel compressor gain control unit 40 for determination of a compressor channel gain to be applied to the signal output 48 of each of the filters of the filter bank 34.

The compressor gain outputs 42 are calculated and applied batch-wise for a block of samples whereby required processor power is diminished. When the compressor operates on blocks of signal samples, the compressor gain control unit 40 operates at a lower sample frequency than other parts of the system. This means that the compressor gains only change every N'th sample where N is the number of samples in the block. Probable artefacts caused by fast changing gain values are suppressed by three low-pass filters 44 at the gain outputs 42 of the compressor gain control unit 40 for smoothing gain changes at block boundaries.

The output signals 48 from the filter bank 34 are multiplied with the corresponding individual low-pass filtered gain outputs 46 of the compressor gain control unit 40, and the resulting signals 49 are added in adder 50 to form the compressed signal 52 that is input to the multi-channel amplifier 30. The compressor 24 provides attenuation only, i.e. in each frequency channel, the compressors provide the different desired gains for soft sounds and loud sounds, while the multi-channel amplifier 30 provides the frequency dependent amplification of the soft sounds corresponding to the recorded frequency dependent hearing thresholds of the intended user of the binaural hearing aid system.

The multi-channel amplifier 30 has minimum-phase FIR filters with a suitable order. Minimum-phase filters guarantee minimum group delay in the system. The filter parameters are determined when the system is fitted to a patient and does not change during operation. The design process for minimum-phase filters is well known.

FIG. 3 shows an example of binaural compression in the compressor 24 of the signal processor 16 in more detail. FIG. 3 illustrates processing in a single frequency band or channel. The illustrated single frequency channel may constitute the entire frequency channel of a single-channel binaural compressor; or, the illustrated single frequency channel may constitute one individual frequency channel of a multi-channel binaural compressor.

FIG. 3 also shows the transceiver 22 of the hearing aid 10 that performs wireless transmission of data between the hearing aids of the binaural hearing aid system with a low data rate and therefore with low power consumption.

The microphone 12, A/D converter 12, D/A converter 18, and receiver 20 are not shown in FIG. 3.

As also illustrated in FIG. 2, a gain output signal 46 from the compressor gain control unit 40, e.g. a gain table, is multiplied to the input signal 48 to form compressed signal 49. A signal level detector 38 is provided for determining and outputting a signal level that is a first function of the digital input signal, such as an rms-value, a mean amplitude value, a peak value, an envelope value, e.g. as determined by a peak detector, etc., of the input signal in the respective frequency channel. In a conventional compressor, the output of the signal level detector 38 forms the compressor control signal 54, see also FIG. 2. However, in the binaural compressor, a signal from the other hearing aid is taken into account together with the conventional compressor control signal when the compressor control signal is formed, whereby binaural compression is performed. Thus, a signal parameter detector 56 is provided for determining and outputting a signal parameter that is a second function of the digital input signal for use in the hearing aid in which it has been determined and for transmission to the other hearing aid by the wireless transceiver 22. The transceiver 22 transmits the signal parameter to the other hearing aid. The signal parameter value is also stored in a delay 58, or another type of memory, in the hearing aid in which it has been determined, so that the stored value can be processed later together with a signal parameter value concurrently determined in the other hearing aid and received from the other hearing aid, for example in order to determine a directional cue based on the simultaneously, or substantially simultaneously determined values, of the signal parameters of the two hearing aids, for example the interaural level difference of the input signal. In order to be able to determine the interaural level difference, the signal parameter is also a function of the input signal, such as an rms-value, a mean amplitude value, a peak value, an envelope value, e.g. as determined by a peak detector etc., of the input signal. The signal parameter may be of the same type as the signal level, e.g. rms-values determined with different time constants; or, the signal parameter may be identical to the signal level, in which case the signal level detector 38 and the signal parameter detector 56 is the same unit, the output of which is connected to the second binaural unit 62, the memory 58, and the transceiver 22.

In the binaural compressor illustrated in FIG. 3, the interaural level difference is calculated in first binaural unit 60 and output to the second binaural unit 62. In the second binaural unit 62, the compressor control signal is adjusted based on the output from the first binaural unit 60. For example, the second binaural unit 62 may determine whether the interaural level difference is positive or negative. If positive, the compressor control signal is set to be equal to the output from the signal level detector 38, i.e. the compressor operates similarly to a conventional compressor and as shown in FIG. 2; however, if the interaural level difference is negative, the second binaural unit 62 adds the interaural level difference to the current output signal of the signal level detector and outputs the sum as the compressor control signal 54, thereby shifting the compressor control signal to a higher value. In this way, the compressor control signal 54 of one hearing aid will always have the same value, or substantially the same value, as the compressor control signal of the other hearing aid, and in this way the sense of direction is maintained irrespective of the type of hearing loss, i.e. symmetric or asymmetric hearing loss, of the user. It is noted that the values of the signal parameter are old as compared to the current value of the signal level input to the second binaural unit 62. However, since the signal parameter values are used to determine a slowly varying parameter, such as the interaural level difference, the difference in time of determination of the signal level and the respective signal parameters does not affect the performance of the new binaural hearing aid system.

In general, the new binaural hearing aid system performs binaural signal processing due to the fact that in at least one frequency channel of at least one of the compressors, the gain of the compressor is controlled by a compressor control signal that is a function of the signal level and signal parameter of the respective hearing aid accommodating the compressor, and the signal parameter received from the other hearing aid. In this way, improved binaural hearing impairment compensation is facilitated.

In order to keep power consumption at a low level, wireless data communication of the signal parameter is performed at a data rate that is slower than the attack and release times of the compressor, i.e. the time between consecutive transmissions of the signal parameter is longer than the attack and release times of the compressor. Therefore, binaural parameters are identified for incorporation into the binaural signal processing, such as binaural compression, which varies at a rate that makes it suitable for use in connection with wireless data transmission at the low data rate.

For example, directional cues, such as the interaural level difference, of a sound signal arriving at the ears of a person will typically vary slowly as illustrated in FIG. 4, and in the rare event that the directional cue undergoes a rapid change, the duration of the rapid change will typically be so short that it does not affect the performance of the new binaural hearing aid system.

FIG. 4 schematically illustrates a top view of a situation in which a person receives sound from a sound source positioned to the left of the forward looking direction of the person. In this case, sound from the sound source arrives first at the left ear and subsequently, with a small delay, at the right ear. The difference in arrival times of the sound from the same sound source is denoted the interaural time difference. Further, the sound arriving at the left ear has larger sound pressure level than sound from the same sound source arriving at the right ear. The difference in sound pressure levels is denoted interaural level difference. When the sound source moves with relation to the person, the interaural level difference and the interaural time difference change accordingly, and it is believed that these two directional cues are the most important cues for the person's determination of the direction to the sound source. Since a sound source typically moves with modest speeds with relation to the person, in particular when the sound source is another person speaking to the person in question, it is seen that interaural time difference and interaural time level will be subject to rather slow changes.

Thus; the data rate of the binaural hearing aid system may be lower than 100 Hz, such as lower than 90 Hz, such as lower than 80 Hz, such as lower than 70 Hz, such as lower than 60 Hz, such as lower than 50 Hz, etc.

Typically, inherent similarities of the two hearing aids of a binaural hearing aid system ensure that the delays from input to output of the hearing aids do not change the interaural time difference so that extra precautions need not be taken to preserve interaural time difference in the binaural hearing aid system.

In the illustrated binaural hearing aid, the compressor control signals are adjusted to be of the same value, or substantially the same value, so that the gain output 46 of the compressor is the same, or substantially the same, in both hearing aids in order to keep the interaural level difference before and after compression unchanged.

FIG. 5 shows another example of binaural compression in the compressor 24 of the signal processor 16 in more detail. FIG. 5 illustrates processing in a single frequency band or channel. The illustrated single frequency channel may constitute the entire frequency channel of a single-channel binaural compressor; or, the illustrated single frequency channel may constitute one individual frequency channel of a multichannel binaural compressor.

FIG. 5 also shows the transceiver 22 of the hearing aid 10 that performs wireless transmission of data between the hearing aids of the binaural hearing aid system with a low data rate and therefore with low power consumption.

The microphone 12, A/D converter 12, D/A converter 18, and receiver 20 are not shown in FIG. 5.

The binaural compressor illustrated in FIG. 5 is configured to perform modelling of healthy COCB effects for the hearing impaired as disclosed in U.S. Pat. No. 7,630,507; however modified for low data rate wireless data transmission of the signal parameter between the hearing aids of the binaural hearing aid system. Data transmission is performed with a time period between consecutive transmissions of signal parameter values that is longer than the attack and release times of the compressors.

Additionally, the illustrated binaural compressor may be configured to perform the modelling of the healthy COCB effects in combination with maintaining sense of direction as disclosed above.

In the illustrated compressor, as in a conventional compressor, a signal level detector 38 is provided for determining and outputting a signal level that is a first function of the digital input signal 48, such as an rms-value, a mean amplitude value, a peak value, an envelope value, e.g. as determined by a peak detector, etc., of the input signal 48 in the respective frequency channel. The output of the signal level detector 38 forms the compressor control signal 54 controlling the gain output signal 46 of the compressor gain control unit 40, e.g. holding a gain table. The gain output signal 46 is multiplied with the input signal 48 to form compressed signal 49.

In FIG. 5, the healthy COCB effect is modelled, i.e. a high sound pressure output by the other hearing aid masks the output of the hearing aid accommodating the compressor illustrated in FIG. 5. Thus, a signal parameter is received by transceiver 22 from the other hearing aid and input to the binaural unit 60 that calculates a gain to be multiplied with compressed signal 49 to form output signal 64. High values of the received signal parameter lead to attenuation of the compressed signal 49 whereby the COCB effect is modelled. A table of gain values output by the binaural unit 60 may be determined during fitting by the hearing aid dispenser.

A signal parameter detector 56 is provided for determining and outputting the signal parameter that is a function of the digital output signal 64 for transmission to the other hearing aid by the wireless transceiver 22 for use in the corresponding binaural unit in the other hearing aid.

The signal parameter may be of the same type as the signal level, e.g. rms-values, however determined with longer time constants suitable for the low data rate of the wireless data transmission.

Although particular embodiments have been shown and described, it will be understood that they are not intended to limit the claimed invention, and it will be obvious to those skilled in the art that various changes and modifications may be made without departing from the spirit and scope of the claimed invention. The specification and drawings are, accordingly, to be regarded in an illustrative rather than restrictive sense. The claimed invention is intended to cover alternatives, modifications, and equivalents.

The invention claimed is:

1. A binaural hearing aid system comprising:

a first hearing aid and a second hearing aid, each of which comprising a microphone and an A/D converter for provision of a digital input signal in response to sound signals received at the microphone, a signal parameter detector for determining and outputting a signal parameter, a transceiver for wireless data communication of the signal parameter with the other hearing aid, a processor that is configured to process the digital input signal in accordance with a signal processing algorithm into a processed digital output signal, the processor including a compressor for compensation of dynamic range hearing loss, and a D/A converter and an output transducer for conversion of the processed digital output signal to an acoustic output signal;

wherein, in the first hearing aid, a gain of the compressor is controlled by a compressor control signal that is a function of (1) the signal parameter of the first hearing aid that is a current signal parameter of the first hearing aid, (2) an additional signal parameter of the first hearing aid that is an old signal parameter of the first hearing aid, and (3) the signal parameter received from the second hearing aid; wherein the signal parameter received from the second hearing aid comprises an old signal parameter of the second hearing aid that is for a time different from that of the current signal parameter for the first hearing aid; and wherein the transceiver in the first hearing aid is configured to operate at a data transmission rate with a time period between consecutive transmissions that is longer than an attack and release time of the compressor in the first hearing aid.

2. The binaural hearing aid system according to claim 1, wherein the data transmission rate that is lower than 100 Hz.

3. The binaural hearing aid system according to claim 1, wherein the data transmission rate that is lower than 50 Hz.

4. The binaural hearing aid system according to claim 1, wherein the binaural hearing aid system is configured to preserve directional cues of the sound signals at one of the first and second hearing aids by adjusting the compressor control signal in the first hearing aid, a compressor control signal in the second hearing aid, or both.

5. The binaural hearing aid system according to claim 4, wherein the binaural hearing aid system is configured to preserve the directional cues of the sound signals at one of the first and second hearing aids by adjusting one or both of the compressor control signals in the first and second hearing aids to have a same value.

6. The binaural hearing aid system according to claim 1, wherein the binaural hearing aid system is configured to preserve directional cues of the sound signals at one of the first and second hearing aids in such a way that an inter aural level difference before and after compression by the compressor remains unchanged.

7. The binaural hearing aid system according to claim 1, wherein the compressor control signal of the first hearing aid is a function of a successfully transmitted signal parameter from the second hearing aid, and the signal parameter of the first hearing aid.

8. The binaural hearing aid system according to claim 1, wherein at least one of the compressors of the first and second hearing aids is a multi-channel compressor for compensation of dynamic range hearing loss.

9. The binaural hearing aid system according to claim 8, wherein the multi-channel compressor comprises a filter bank with linear phase filters.

10. The binaural hearing aid system according to claim 9, wherein the filter bank comprises warped filters.

11. The binaural hearing aid system according to claim 9, wherein crossover frequencies of the filter bank are adjustable.

12. The binaural hearing aid system according to claim 9, wherein the filter bank comprises cosine-modulated filters.

13. The binaural hearing aid system according to claim 9, wherein compressor gain for the multi-channel compressor is calculated and applied for a block of samples.

14. The binaural hearing aid system according to claim 13, wherein the multi-channel compressor further comprises a multi-channel low-pass filter for low-pass filtering of the calculated compressor gain.

15. The binaural hearing aid system according to claim 1, wherein the signal parameter from the signal parameter detector of the first hearing aid includes information regarding a sound pressure level.

16. The binaural hearing aid system according to claim 1, wherein the current signal parameter of the respective hearing aid represents current sound pressure associated with the respective hearing aid, the old signal parameter of the other hearing aid represents old sound pressure associated with the other hearing aid, and the old signal parameter of the respective hearing aid represents old sound pressure associated with the respective hearing aid.

17. A hearing aid system comprising:

a first hearing aid configured to communicate with a second hearing aid, the first hearing aid comprising a microphone and an A/D converter for provision of a digital input signal in response to sound signals received at the microphone, a signal parameter detector for determining and outputting a signal parameter, a transceiver for wireless data communication of the signal parameter with the second hearing aid, a processor that is configured to process the digital input signal in accordance with a signal processing algorithm into a processed digital output signal, the processor including a compressor for compensation of dynamic range hearing loss, and a D/A converter and an output transducer for conversion of the processed digital output signal to an acoustic output signal;

wherein, in the first hearing aid, a gain of the compressor is controlled by a compressor control signal that is a function of (1) the signal parameter of the first hearing aid that is a current signal of the first hearing aid, (2) an additional signal parameter of the first hearing aid that is an old signal parameter of the first hearing aid, and (3) a signal parameter received from the second hearing aid, wherein the signal parameter received from the second hearing aid comprises an old signal parameter of the second hearing aid that is for a time different from that of the current signal parameter for the first hearing aid; and wherein the transceiver is configured to operate at a data transmission rate with a time period between consecutive transmissions that is longer than an attack and release time of the compressor.

18. The hearing aid system according to claim 17, wherein the data communication of the signal parameter from the first hearing aid is performed at a data rate that is lower than 100 Hz.

19. The hearing aid system according to claim 17, wherein the data communication of the signal parameter from the first hearing aid is performed at a data rate that is lower than 50 Hz.

20. The hearing aid system according to claim 17, wherein the function preserves directional cues of the sound signals at the first hearing aid by adjusting the compressor control signal in the first hearing aid, a compressor control signal in the second hearing aid, or both.

21. The hearing aid system according to claim 20, wherein the function preserves the directional cues of the sound signals at the first hearing aid by adjusting one or both of the compressor control signals in the first and second hearing aids to have a same value.

22. The hearing aid system according to claim 17, wherein the function preserves directional cues of the sound signals at the first hearing aid by adjusting the compressor control signal in the first hearing aid, a compressor control signal in the second hearing aid, or both, so that an inter aural level difference before and after compression by the compressor remains substantially unchanged.

23. The hearing aid system according to claim 17, wherein the compressor control signal of the first hearing aid is a function of a successfully transmitted signal parameter from the second hearing aid, and the signal parameter of the first hearing aid.

24. The hearing aid system according to claim 17, wherein the compressor of the first hearing aid is a multi-channel compressor for compensation of dynamic range hearing loss.

25. The hearing aid system according to claim 17, wherein the current signal parameter of the first hearing aid represents current sound pressure associated with the first hearing aid, the old signal parameter of the second hearing aid represents old sound pressure associated with the second hearing aid, and the old signal parameter of the first hearing aid represents old sound pressure associated with the first hearing aid.

26. A method in a hearing aid system with a first hearing aid and a second hearing aid, the method comprising:

in the first hearing aid, converting received sound into an input signal, determining a signal parameter, performing wireless communication of the signal parameter with the second hearing aid, processing the input signal in accordance with a signal processing algorithm into a processed digital output signal, wherein the act of processing includes compression for compensation of dynamic range hearing loss, converting the processed digital output signal to an acoustic output signal; and controlling compression gain as a function of (1) the signal parameter of the first hearing aid that is a current signal parameter of the first hearing aid, (2) an additional signal parameter of the first hearing aid that is an old signal parameter of the first hearing aid, and (3) a signal parameter received from the second hearing aid, wherein the signal parameter received from the second hearing aid comprises an old signal parameter of the second hearing aid that is for a time different from that of the current signal parameter for the first hearing aid;

wherein the wireless communication is performed at a data transmission rate with a time period between consecutive transmissions that is longer than an attack and release time of a compressor.

27. The method of claim 26, wherein the current signal parameter of the first hearing aid represents current sound pressure associated with the first hearing aid, the old signal parameter of the second hearing aid represents old sound pressure associated with the second hearing aid, and the old signal parameter of the first hearing aid represents old sound pressure associated with the first hearing aid.

28. A hearing aid system comprising:

a first hearing aid and a second hearing aid, wherein the first hearing aid is configured to communicate with the second hearing aid;

wherein the first hearing aid comprises:

a microphone and an A/D converter for provision of a digital input signal in response to sound signals received at the microphone, a signal parameter unit for outputting a first signal parameter, a transceiver for wireless data communication with the second hearing aid, wherein the transceiver of the first hearing aid is configured to receive a second signal parameter from the second hearing aid, and a processor that is configured to generate an output based at least in part on the first signal parameter from the signal parameter unit of the first hearing aid and the second signal parameter received from the second hearing aid;

wherein the first signal parameter comprises a current signal parameter, and the second signal parameter received from the second hearing aid comprises an old signal parameter that associated with a time different from that of the current signal parameter;

wherein the processor is configured to generate the output also based on a third signal parameter; and wherein the transceiver is configured to operate at a data transmission rate with a time period between consecutive transmissions that is longer than an attack and release time of a compressor.

29. The hearing aid system according to claim 28, wherein the first signal parameter represents current sound pressure associated with the first hearing aid, the second signal parameter received from the second hearing aid represents old sound pressure associated with the second hearing aid, and the third signal parameter represents old sound pressure associated with the first hearing aid.

30. The hearing aid system according to claim 28, wherein the third signal parameter comprises an old signal parameter output by the signal parameter unit of the first hearing aid that is associated with a time different from that of the current signal parameter for the first hearing aid.

31. The hearing aid system according to claim 30, wherein the processor is configured to generate the output based on a difference between the old signal parameter output by the signal parameter unit of the first hearing aid and the old signal parameter received from the second hearing aid.

* * * * *